US008839649B1

(12) United States Patent
Miller et al.

(10) Patent No.: US 8,839,649 B1
(45) Date of Patent: Sep. 23, 2014

(54) LOCKOUT DEVICE

(71) Applicant: Master Lock Company LLC, Oak Creek, WI (US)

(72) Inventors: Jassen R. Miller, Racine, WI (US); Thomas J. Walczak, Oconomowoc, WI (US)

(73) Assignee: Master Lock Company LLC, Oakcreek, WI (US)

( * ) Notice: Subject to any disclaimer, the term of this patent is extended or adjusted under 35 U.S.C. 154(b) by 0 days.

(21) Appl. No.: 13/788,739

(22) Filed: Mar. 7, 2013

(51) Int. Cl.
*E05B 73/00* (2006.01)
*G05G 5/00* (2006.01)

(52) U.S. Cl.
CPC ..... *G05G 5/005* (2013.01)
USPC ..... 70/14; 70/19; 70/30

(58) Field of Classification Search
USPC ..... 70/14, 18, 19, 30, 49, 58
See application file for complete search history.

(56) References Cited

U.S. PATENT DOCUMENTS 2,560,624 A * 7/1951 Bartlett ..... 70/14
3,667,259 A * 6/1972 Reque et al. ..... 70/14
3,703,821 A * 11/1972 Dorey ..... 70/38 R
4,180,996 A 1/1980 Lebrecht
4,864,834 A * 9/1989 Waite ..... 70/14
5,020,342 A * 6/1991 Doan et al. ..... 70/14
5,167,135 A * 12/1992 Gobeski ..... 70/14
5,365,757 A * 11/1994 Primeau ..... 70/14
5,582,042 A * 12/1996 Mordick ..... 70/14
5,881,582 A 3/1999 Monaco
D455,637 S * 4/2002 Reed ..... D8/333
6,997,420 B2 * 2/2006 Yudis et al. ..... 70/14
7,124,606 B2 * 10/2006 Turek ..... 70/14
7,442,888 B2 * 10/2008 Puddicombe et al. ..... 200/43.04
7,501,593 B2 3/2009 Brojanac
8,353,182 B2 * 1/2013 Triffle ..... 70/14

OTHER PUBLICATIONS

Website printout from Cirlock, Lockout Hasps, http://cirlock.com.au/products-and-shopping/lockout-hasps, 2 pages, copyright 2010.

* cited by examiner

*Primary Examiner* — Christopher Boswell
(74) *Attorney, Agent, or Firm* — Calfee, Halter & Griswold LLP

(57) ABSTRACT

A lockout device includes a first member having a first lockout feature and at least a first aperture, and a second member including a second lockout feature and at least a second aperture. The second member is assembled with the first member and is slideable along a range of positions between first and second limit positions of the second member with respect to the first member. The range of positions includes a first lockout position in which the first and second lockout features are positioned to interlock with a first external structure, and a release position in which the first and second lockout features are positioned to disengage from the first external structure.

20 Claims, 13 Drawing Sheets

LOCKOUT DEVICE

BACKGROUND

Security devices, such as for example, padlocks and other types of conventional locks are known in the art. Many security devices are provided for restricting access to equipment and control instruments, including, for example, electrical components, such as switches, dials, push buttons, and electrical connections, and fluid system components, such as valves, pressure regulators, and fluid conduit fittings and connectors.

SUMMARY

In accordance with an aspect of the present application, a lockout device includes a first member having a first lockout feature and at least a first aperture, and a second member including a second lockout feature and at least a second aperture. The second member is assembled with the first member and is slideable along a range of positions between first and second limit positions of the second member with respect to the first member. The range of positions includes a first lockout position in which the first and second lockout features are positioned to interlock with a first external structure, and a release position in which the first and second lockout features are positioned to disengage from the first external structure.

In an exemplary embodiment, a lockout device includes a first member having a first lockout feature and a first set of apertures and a second member having a second lockout feature and a second set of apertures. The second member is assembled with the first member and is slideable in an axial direction with respect to the first member and restricted to a range of positions between a first limit position and a second limit position. The range of positions includes a lockout position in which the first and second lockout features are positioned to interlock with an external structure, and a release position in which the first and second lockout features are positioned to disengage from the external structure. When the second member is in the lockout position, each of the first set of apertures substantially aligns with a corresponding one of the second set of apertures to define a set of passages for receiving a lock member having a cross-section corresponding to the aligned apertures, to secure the second member in the lockout position. When the second member is moved out of the lockout position to any other position in the range of positions, the first member at least partially blocks each of the second set of apertures and the second member at least partially blocks each of the first set of apertures, such that the lock member cannot be assembled with the lockout device to secure the second member in any position other than the lockout position.

In another exemplary embodiment, a lockout device includes a first plate having a first lockout feature and at least a first aperture and a second plate having a second lockout feature and at least a second aperture. The second plate includes a projection disposed within a longitudinal slot in the first plate and slideable between first and second ends of the slot to define a range of positions between first and second limit positions of the second plate with respect to the first plate. The projection includes an enlarged end portion sized to prevent withdrawal of the projection from the slot, thereby securing the second plate to the first plate. The range of positions includes a first lockout position in which the first and second lockout features are positioned to interlock with a first external structure, and a release position in which the first and second lockout features are positioned to disengage from the first external structure. When the second plate is in the first lockout position, the first aperture substantially aligns with the second aperture to define a first passage for receiving a lock member having a cross-section corresponding to the aligned first and second apertures to secure the second member in the first lockout position.

In still another exemplary embodiment, a lockout device includes a first member having a first lockout feature and first and second apertures, and a second member having a second lockout feature and third and fourth apertures. The second member is assembled with the first member and is slideable in an axial direction with respect to the first member and restricted to a range of positions between a first limit position and a second limit position. The range of positions includes a first lockout position in which the first and second lockout features are positioned to interlock with a first external structure, and a second lockout position in which the first and second lockout features are positioned to interlock with a second external structure dimensionally different from the first external structure. When the second member is in the first lockout position, the first aperture substantially aligns with the third aperture to define a first passage for receiving a lock member having a cross-section corresponding to the aligned first and third apertures to secure the second member in the first lockout position. When the second member is in the second lockout position, the fourth aperture substantially aligns with the second aperture to define a second passage for receiving the lock member to secure the second member in the second lockout position.

BRIEF DESCRIPTION OF THE DRAWINGS

Further features and advantages of the invention will become apparent from the following detailed description made with reference to the accompanying drawings, wherein.

DETAILED DESCRIPTION

The Detailed Description merely describes exemplary embodiments and is not intended to limit the scope of the claims in any way. Indeed, the invention as claimed is broader than and unlimited by the exemplary embodiments, and the terms used in the claims have their full ordinary meaning.

Industrial and commercial equipment are often provided with a lockout structure (e.g., a locking bracket or similar structure) to facilitate the restriction of access to, or lockout of, the equipment. The equipment's lockout structure typically includes a hasp or other such apertured member or members configured to receive a shackle (or cable or other retaining member) of a lock to prevent movement of the apertured member with respect to another portion of the lockout structure, thereby preventing access to, or operation of, the equipment.

In some applications, it may be desirable to require the authorization of multiple technicians or other authorized personnel to allow access to, or operation of, a locked out piece of equipment. While a piece of equipment's lockout structure may be sized to retain multiple locks, a safety lockout hasp may instead be provided to be secured to a single apertured lockout structure. A conventional safety lockout hasp includes a shackle to be secured to the equipment's lockout structure, and one or more apertures for receiving shackles (or other lockable retaining members) of one or more locks. Each of the inserted lockable retaining members prevents withdrawal of the shackle from the equipment's lockout structure, thereby requiring removal of all of the lockable retaining members from the safety lockout hasp to remove the lockout hasp from the equipment's lockout structure to allow access to, or operation of, the equipment.

Figure 1A:
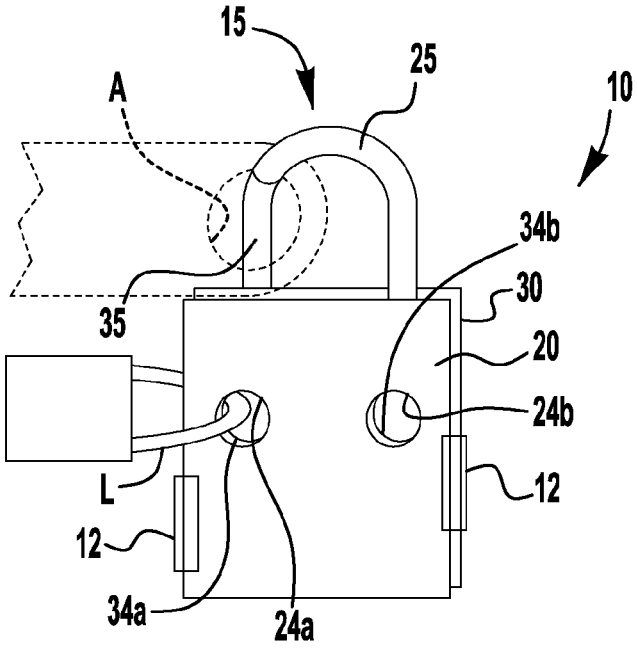
FIG. 1A illustrates a front schematic view of an exemplary lockout device, shown in a closed position.
Figure 1B:
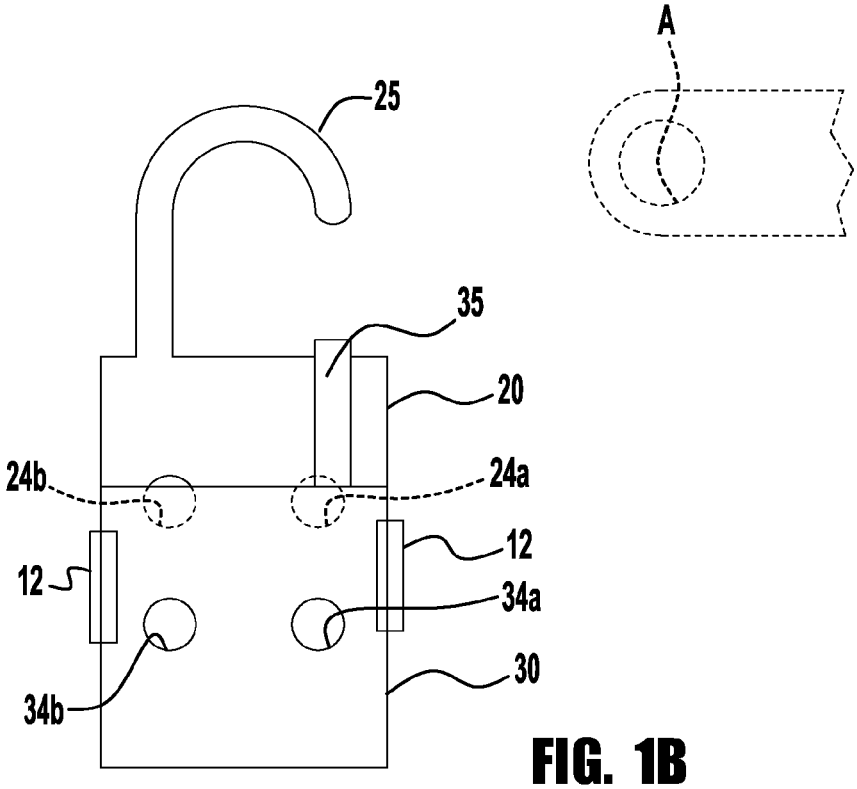
FIG. 1B illustrates a rear schematic view of the lockout device of FIG. 1A, shown in an open position.
Figure 2:
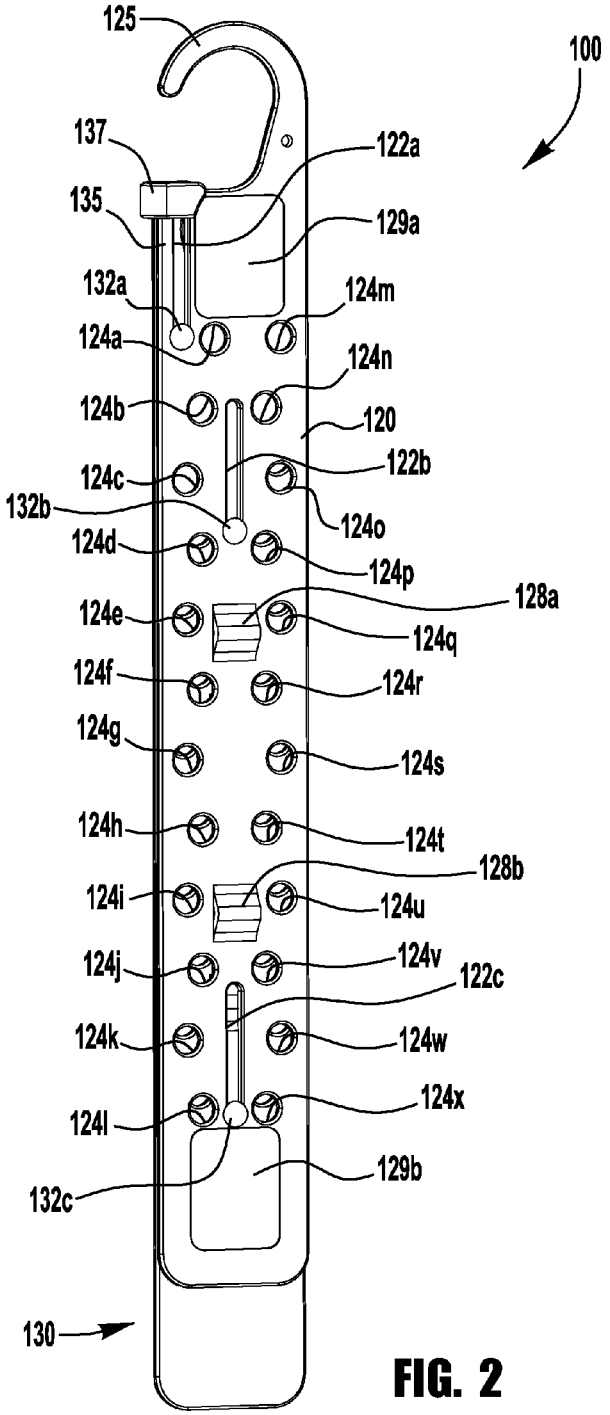
FIG. 2 illustrates a front perspective view of an exemplary safety lockout hasp, shown in an open position.
Figure 3:
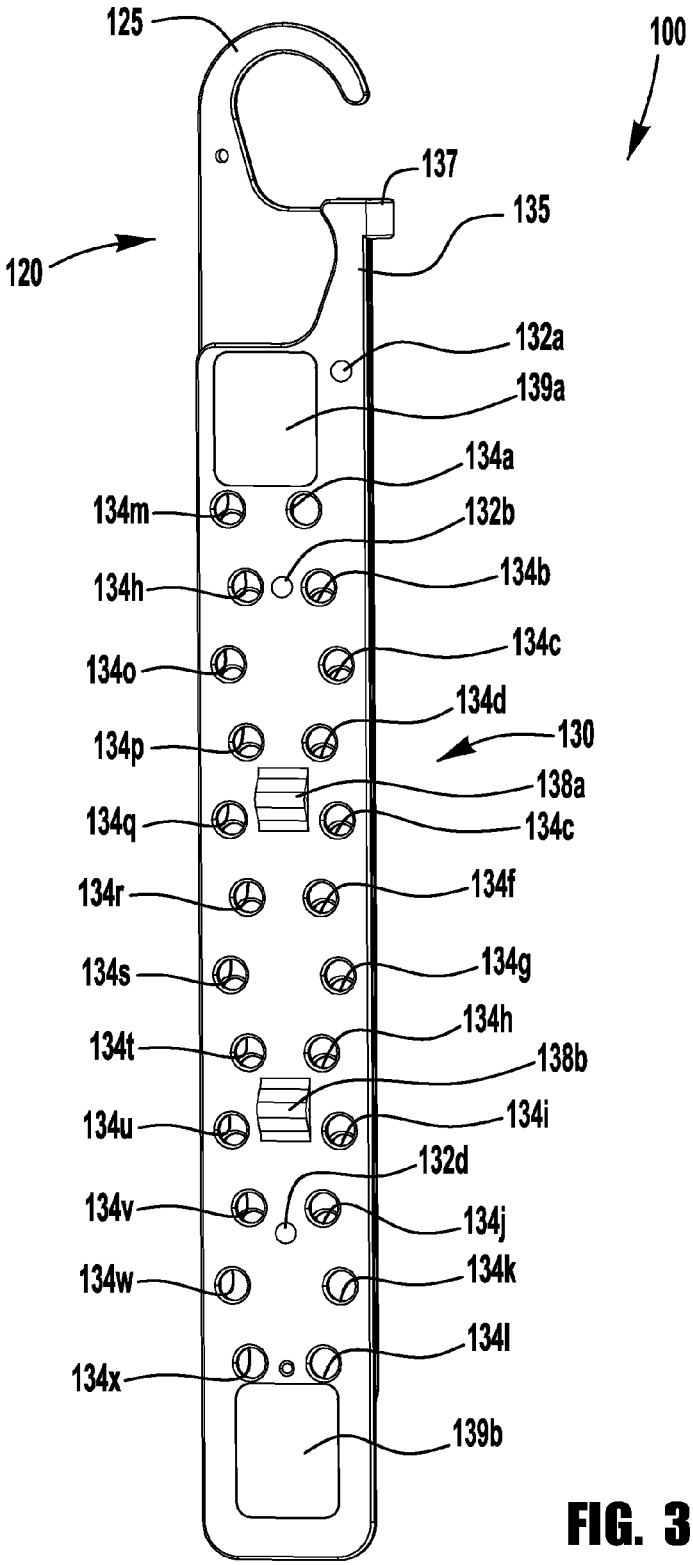
FIG. 3 illustrates a rear perspective view of the safety lockout hasp of FIG. 2, shown in the open position.

According to an aspect of the present application, as shown schematically in FIGS. 1A and 1B, a safety lockout hasp 10 may include first and second members 20, 30 (e.g., plates or other such structural components) coupled to each other at one or more sliding attachments (shown schematically at 12) for axial or translational sliding movement of the first and second members with respect to each other between a closed or lockout position (FIG. 1A) and an open or release position (FIG. 1B). Any type of sliding attachment of the members may be used, including, for example, one or more guide pins, tabs, or other such projections extending from one of the first and second plates and received in one or more corresponding guide slots or tracks in the other of the first and second plates for sliding movement therein. In other embodiments first and second lockout members may be configured to be movable with respect to each other in additional or alternative ways, including, for example, pivotable, rotatable, detachable, and/or slideable movement.

The first member 20 includes a first hasp segment 25, and the second member 30 includes a second hasp segment 35. When the first and second members 20, 30 are in the closed position, the first and second hasp segments 25, 35 align to form a complete, enclosed hasp 15. When the first and second members 20, 30 are moved to the open position, the first and second hasp segments 25, 35 separate, for example, to permit insertion of one of the first and second hasp segments through an apertured lockout structure A (prior to returning the first and second members to the closed position to lock out the associated equipment), or to permit withdrawal of the hasp 15 from the apertured lockout structure to release the equipment from the lockout condition. In the illustrated embodiment of FIGS. 1A and 1B, the first hasp segment 25 forms a hook portion and the second hasp segment forms a leg portion. By sliding the second member 30 with respect to the first member 20, the leg portion 35 is movable in an axial direction to engage the hook portion 25, forming the enclosed hasp 15, in the closed position, and to separate from the hook portion 25 in the open position. In another embodiment, the second hasp segment may be laterally movable to engage the first hasp segment in the closed position and to separate from the first hasp segment in the open position.

In one embodiment, the first and second hasp segments may abut each other in the closed position, defining a seam between ends of the first hasp segment. In another exemplary embodiment, as shown, the first and second hasp segments 25, 35, may overlap in the closed position, for example, to resist efforts to pry the ends of the hasp segments 25, 35 apart from each other in an effort to remove the lockout device 10 from the apertured lockout structure A. In still another embodiment, the ends of the first and second hasp segments may be separated by a gap when in the closed position, with the gap being small enough to prevent removal of the lockout hasp from the apertured lockout structure with which the hasp is assembled.

Any suitable arrangement may be utilized to secure the first and second members in the closed position. In the schematic example, the first and second members 20, include corresponding first and second sets 24, 34 of one or more lock openings 24*a*, 24*b*, 34*a*, 34*b*. When the first and second members 20, 30 are in the closed position, the first and second sets of lock openings 24, 34 align to form a set of lock passages to permit insertion of one or more lock members therethough. When at least one lock member L is inserted through aligned lock openings 24*a*, 34*a* of the first and second sets of lock openings 24, 34, sliding movement of the first and second members 20, 30 to the open position is substantially blocked or obstructed. This condition secures the first and second hasp segments 25, 35 in hasp-forming alignment, for example, to prevent removal of the hasp 15 from the apertured lockout structure A.

Figure 4:
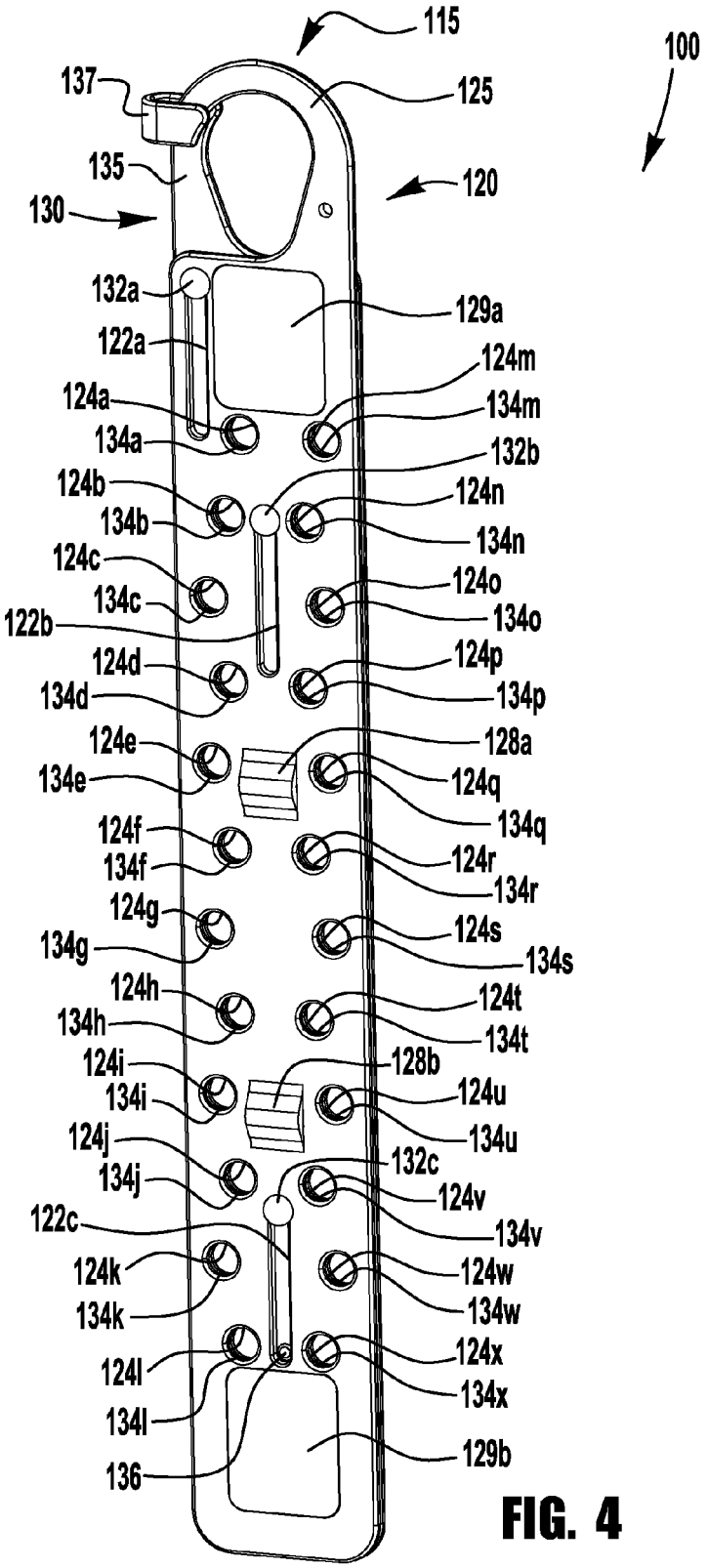
FIG. 4 illustrates a front perspective view of the safety lockout hasp of FIG. 2, shown in a closed position.
Figure 5A:
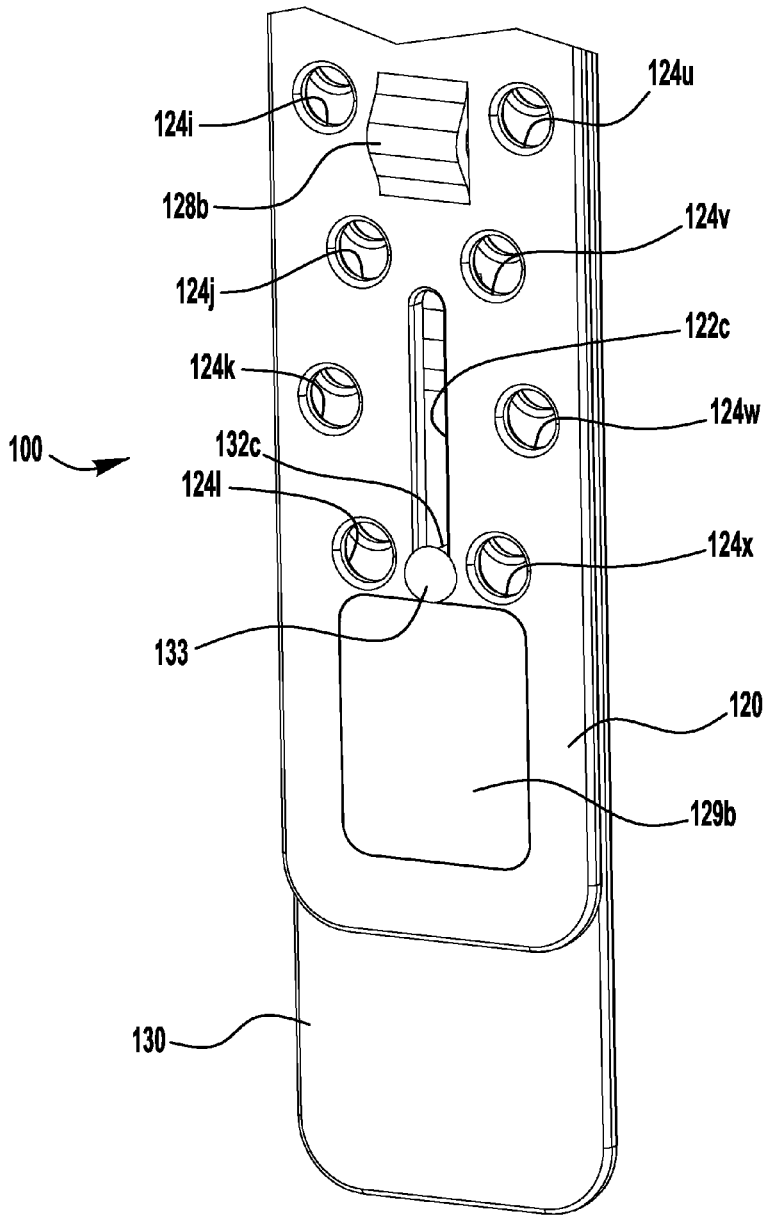
FIG. 5A is an enlarged partial front perspective view of the safety lockout hasp of FIG. 2, shown in the open position.
Figure 5B:
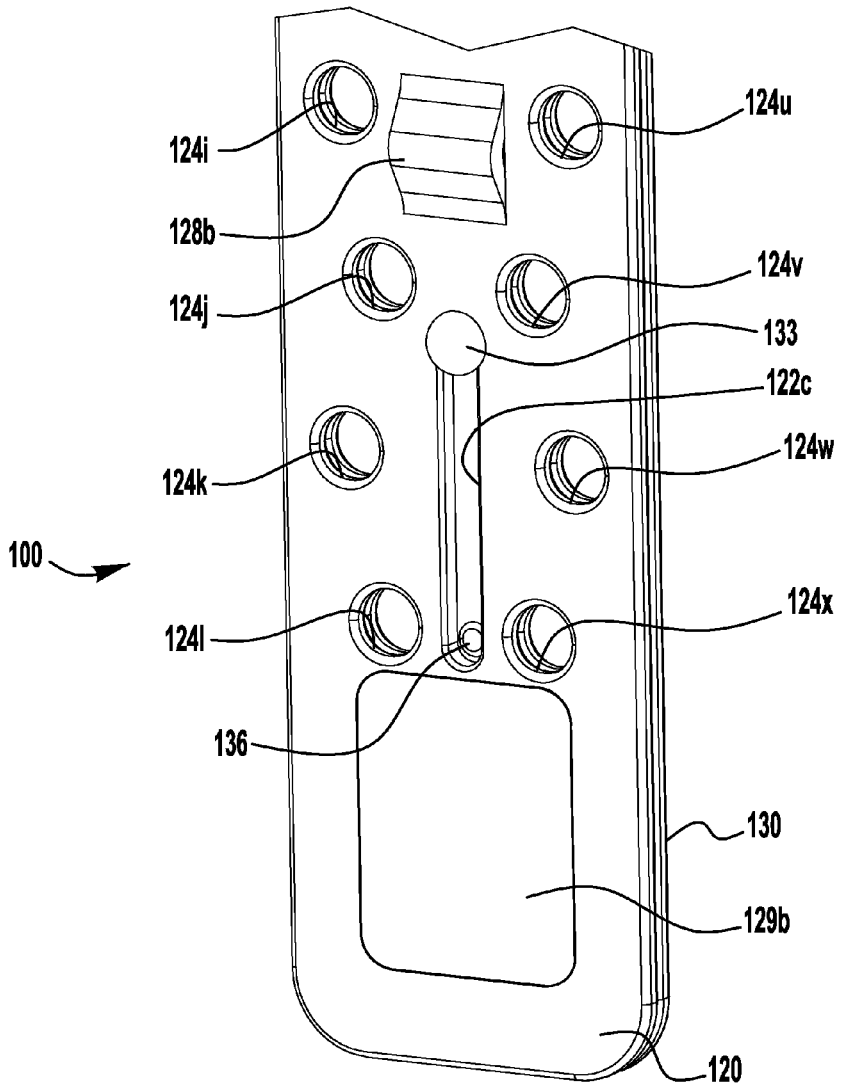
FIG. 5B is an enlarged partial front perspective view of the safety lockout hasp of FIG. 2, shown in the closed position.

FIGS. 2-6 illustrate various views of an exemplary safety lockout hasp 100 including many of the inventive features described herein. The lockout hasp 100 includes first and second plates 120, 130 coupled to each other for axial or translational sliding movement of the first and second plates with respect to each other between an open or release position (FIGS. 2 and 3) and a closed or lockout position (FIG. 4). While any type of sliding attachment of the plates may be used, in the illustrated embodiment, guide pins or other such projections 132*a-c* (e.g., rivets or other fasteners) extend from the second plate 130 and are received corresponding guide slots 122*a-c* in the first plate 120 for sliding movement therein. The guide pins 132*a-c* are captured in the corresponding slots 122*a-c* by an enlarged end portion or head 133 (FIGS. 5A and 5B) at the end of the guide pin 132*a-c* to prevent separation from the slots 122*a-c*. Engagement of the guide pins 132*a-c* with the ends of the corresponding slots 122*a-c* defines a range of positions between a first limit position (which may, but need not, coincide with the lockout position) and a second limit position (which may, but need not, coincide with the release position). The use of multiple guide pin/slot attachments may provide for more secure attachment of the two plates 120, 130 and greater resistance to efforts to pry apart the plates 120, 130. In the illustrated embodiment, the guide pins 132*a-c* are captured in the corresponding slots 122*a-c* along an entire range of motion within the slots, for example, to securely retain the plates 120, 130 together when the device 100 is not in use. In another embodiment (not shown), the guide pins are permitted to separate from the corresponding slots when the plates are in the open position, for example, by providing the slots with an enlarged end. This arrangement may facilitate assembly and disassembly of the lockout hasp for example, for efficient storage of the lockout hasp in a disassembled condition.

The first plate 120 includes a first hasp segment 125, and the second plate 130 includes a second hasp segment 135. When the first and second plates 120, 130 are in the closed position, the first and second hasp segments 125, 135 align to form a complete, enclosed hasp 115. In the exemplary embodiment, the first hasp segment 125 is formed as a curved hook portion and the second hasp segment 135 is formed as a substantially straight leg portion. In the closed position, the end of the second hasp segment 135 overlaps with the end of the first hasp segment 125, for example, to provide further rigidity of the enclosed hasp 115 and to resist efforts to pry the ends of the hasp segments 125, 315 apart from each other in an effort to remove the lockout device 100 from an apertured lockout structure.

When the first and second plates 120, 130 are moved to the open position, the first and second hasp segments 125, 135 separate, for example, to permit insertion of one of the first and second hasp segments through an apertured lockout structure (prior to returning the first and second plates 120, 130 to the closed position to lock out the associated equipment), or to permit withdrawal of the hasp 115 from an apertured lockout structure to release the equipment from the lockout condition.

The first and second plates 120, 130 include corresponding first and second sets of one or more lock apertures or openings 124*a-x*, 134*a-x*. When the first and second plates 120, 130 are in the closed position, the first and second sets of lock openings 124*a-x*, 134*a-x* substantially or fully align to form a set of lock passages to permit insertion of a lock member of a cross-section corresponding to the lock apertures (e.g., a padlock having a shackle sized to be closely received through the lock apertures). The lock apertures may be provided in a range of sizes and shapes, including, for example, circular holes having a diameter of approximately 0.33 inches to accommodate a conventional padlock shackle. When at least one lock member is inserted through one of the pairs of aligned lock openings 124*a-x*, 134*a-x* of the first and second sets of lock openings, sliding movement of the first and second plates 120, 130 to the open position is substantially blocked or obstructed. This condition secures the first and second hasp segments 125, 135 in hasp-forming alignment, for example, to prevent removal of the hasp 115 from an apertured lockout structure.

While the hasp segments 125, 135 may be provided in many different sizes, in one embodiment, the hasp segments are approximately 4 mm in width, to accommodate, for example, the smaller standard lockout apertures of conventional ISO/DIN type equipment. By providing hasp segments having a smaller width or diameter than the size of the lockout padlock shackle (or other retaining member) accommodated by the lock apertures 124*a-x*, 134*a-x*, the safety lockout hasp 100 may be used as a type of adapter for padlocks (or other locks) having shackles (or other retaining members) that are too large to fit in a smaller lockout aperture.

While a safety lockout hasp may be provided in any suitable shape, as shown in the illustrated embodiment, relatively narrow plates 120, 130 may be used to allow for installation in applications with minimal available clearance. By limiting sliding movement of the plates 120, 130 with respect to each other to a longitudinal direction (i.e., substantially parallel to the length of the plates, as opposed to lateral, pivotal, or hinged movement), minimal clearance of the hasp device 100 may be maintained throughout operation of the device 100. In an exemplary embodiment, the plates 100 may be provided with a width no greater than an outer diameter of the hasp portion 115. Additionally or alternatively, the plates 120, 130 may have a width of approximately 1.75 inches.

Figure 6:
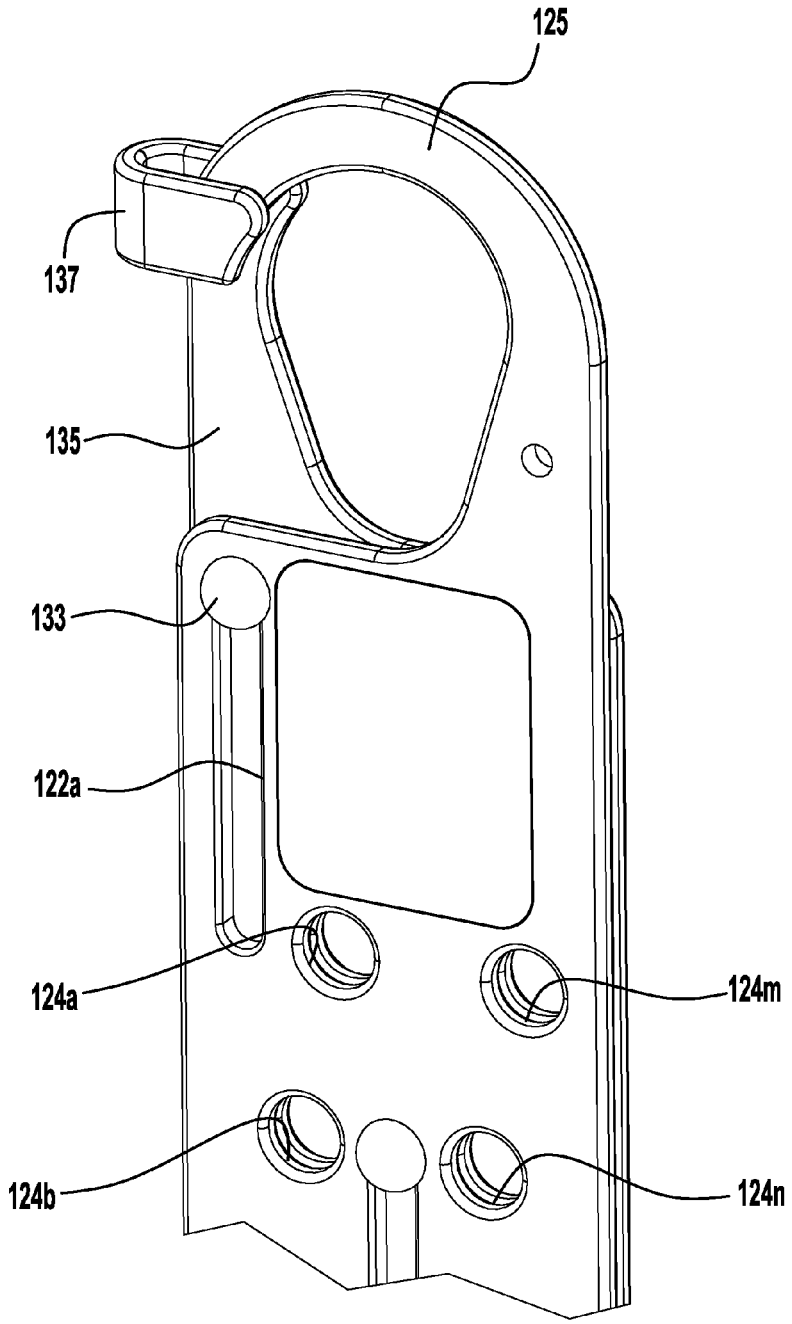
FIG. 6 is an enlarged partial front perspective view of the hasp portion of the safety lockout hasp of FIG. 2, shown in the closed position.

Still other features and configurations may additionally or alternatively be utilized in a safety lockout device in accordance with the present application. For example, the hasp segments 125, 135 may be embossed or ribbed for added strength and rigidity, which may, for example, allow for use of thinner plates and/or softer materials (e.g., plastic). As another example, one of the hasp portions may be provided with a sheath portion shaped to wrap around the other hasp portion in the lockout position to prevent the hasp portion from being flexed or bent away from each other for unauthorized removal of the lockout hasp. In the illustrated embodiment, as best shown in FIG. 6, the hasp segment 135 of the second plate 130 includes a sheath portion 137 that wraps around the hasp segment 125 of the first plate 120 in the lockout position.

As another example, the lock apertures of first and second members of a lockout device may be positioned such that a lock member (e.g., a padlock having a shackle with a cross-section corresponding to the lock apertures) cannot be assembled with the lockout device in any position other than the lockout position. This arrangement prevents inadvertent or unintentional locking of the device in an open (release) or partially open position). In one embodiment, in any position other than the lockout position, each of the lock apertures in the first member is at least partially blocked by the second member to prevent insertion of a lock member (e.g., a padlock having a shackle with a cross-section corresponding to the lock apertures) therethrough, and each of the lock apertures in the second member is at least partially blocked by the first member to prevent insertion of a lock member therethrough. As one example, as shown, adjacent lock apertures 124*a-x*, 134*a-x* may be staggered, such that lock apertures 124*a-x* of the first plate 120 only substantially or fully align with lock apertures 134*a-x* of the second plate 130 when the first and second plates 120, 130 are in the closed position. As another example, lock apertures that are axially aligned (i.e., centered along an axis of movement of the sliding plates 120, 130), e.g. lock apertures 124*c* and 124*e*, may be spaced apart (as measured from the aperture center points) by a distance that is greater than the range of motion of the second plate 130 with respect to the first plate 120, such that a lock aperture 124*e* cannot substantially align with the second plate lock aperture 134*c* corresponding to the other first plate lock aperture 124*c*.

As still another example, one of the first and second plates may be provided with a detent that releasably interlocks with a corresponding feature (e.g., slot, groove, recess, or complementary raised detent) in the other of the plates when the first and second plates are in the closed position. This feature holds the plates in the closed position, for example, to facilitate user assembly of a padlock with one or more pairs of aligned lock apertures. While any detent engaging feature may be utilized, in one exemplary embodiment, a raised detent may be positioned to be received in one of the guide slots when the device is in the closed or lockout position. In the illustrated embodiment, the second plate 130 includes a detent 136 that releasably interlocks with an end of the slot 122*c* in the first plate 120 when the first and second plates are in the closed position.

As yet another example, one or both of the plates 120, 130 may be provided with one or more user engageable projections or pads 128*a-b*, 138*a-b* to facilitate sliding movement of the plates 120, 130 with respect to each other.

As another example, one or both of the plates 120, 130 may be provided with labels 129*a-b*, 139*a-b*, for example, to provide lockout information.

While the safety lockout hasp components may be provided in many different materials, in one embodiment, the plates 120, 130 are provided in plastic or some other dielectric or non-conductive material, for example, to reduce the risk of electrical shock to the user. In other embodiments, these components may be provided in metals, such as steel or aluminum, or in some other suitable material. The safety lockout hasp components may be provided in many different sizes, shapes, and dimensional configurations, for example, to accommodate different equipment lockout apertures and padlocks or other retaining members.

Mating hasp segments are but one example of a variety of lockout features that may be utilized in a lockout device to interlock with an external structure. Other lockout devices, including sliding lockout devices (e.g., assembled plates having slot and guide pin arrangements, as described above) may additionally or alternatively utilize any one or more of the features described in the present application to provide sliding operation between a release position and one or more lockable lockout positions.

Figure 7A:
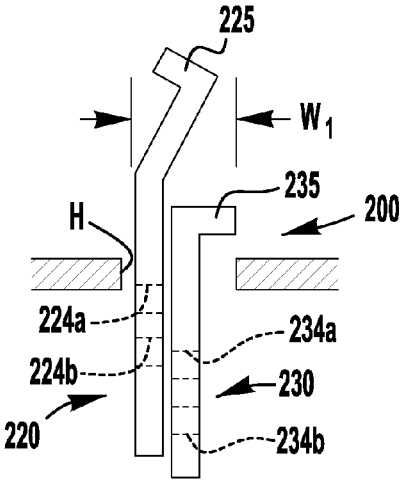
FIG. 7A is a side schematic view of another exemplary lockout device, shown in a release position.
Figure 7B:
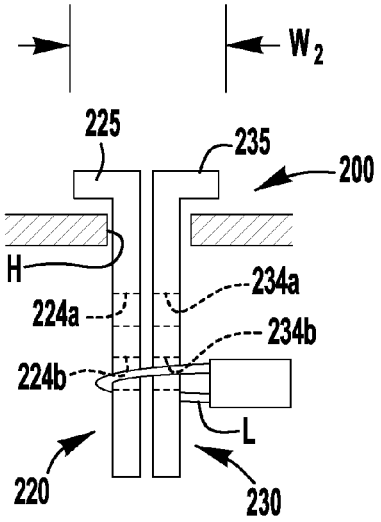
FIG. 7B is a side schematic view of the lockout device of FIG. 7A, shown in a lockout position.

In one such exemplary embodiment, a sliding lockout device may be configured for locking engagement with a hole in a structure, including, for example, an anchoring hole in a portable device, such as a security slot in a laptop computer. FIGS. 7A and 7B schematically illustrate (from a side view) a lockout device 200 including a first plate 220 having a first flanged tab 225 (or other suitable lockout feature) and a first set of lock apertures 224*a*, 224*b*, and a second plate 230 having a second flanged tab 235 (or other suitable lockout feature) and a second set of lock apertures 234*a*, 234*b*. As shown in FIG. 7A, the first flanged tab 225 is biased inward toward the second plate 230, such that in the release position, the tabs 225, 235 define a first width w1 small enough for the tabs to fit through anchoring hole H. When the second plate 230 is slid (e.g., using slot and guide pin arrangements, as shown and described above) to the lockout position (FIG. 7B) the second plate 230 forces the first flanged tab 225 outward to define a second width w2 large enough to anchor the flanged tabs 225, 235 within the anchoring hole H. In this lockout position, the first set of lock apertures 224*a*, 224*b* substantially or fully aligns with the second set of lock apertures 234*a*, 234*b* to define a set of lock passages for receiving one or more locking members L (e.g., padlock shackles) to secure the device in the lockout position.

Figure 8A:
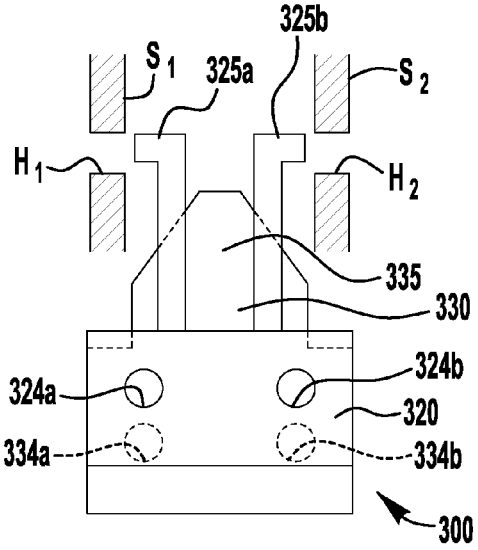
FIG. 8A is front schematic view of another exemplary lockout device, shown in a release position.
Figure 8B:
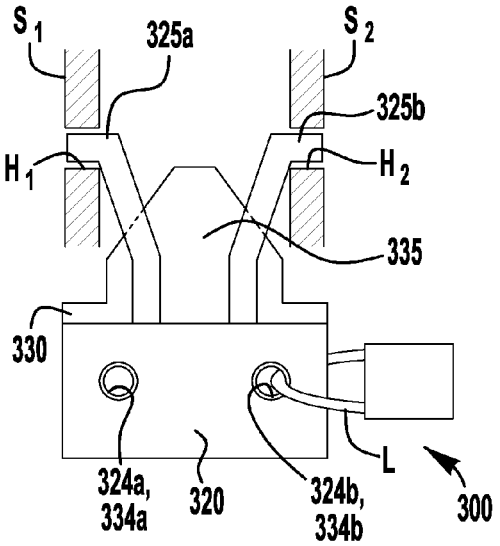
FIG. 8B is a front schematic view of the lockout device of FIG. 8A, shown in a lockout position.

In another exemplary embodiment, a sliding lockout device may be configured for locking engagement with aligned holes in spaced apart walls, including, for example, holes in side walls of an ISO/DIN circuit breaker switch assembly. Examples of other ISO/DIN circuit breaker lockout devices that engage with these side wall holes are described in U.S. Pat. No. 7,501,593 to Brojanac, the entire disclosure of which is incorporated herein by reference. FIGS. 8A and 8B schematically illustrate a lockout device 300 including a first plate 320 having first and second flanged prongs or tabs 325*a*, 325*b* (or other suitable lockout feature) and a first set of lock apertures 324*a*, 324*b*, and a second plate 330 having a wedge shaped portion 335 (or other suitable lockout feature) and a second set of lock apertures 334*a*, 334*b*. As shown in FIG. 8A, the first and second flanged tabs 325*a*, 325*b* are biased inward toward each other, such that in the release position, the tabs 325*a*, 325*b* define a first width small enough for the tabs to fit between opposed side walls S1, S2. When the second plate 330 is slid (e.g., using slot and guide pin arrangements, as shown and described above) to the lockout position (FIG. 8B) the wedge shaped portion 335 of the second plate 330 forces the first and second flanged tabs 325*a*, 325*b* outward such that the tabs extend through aligned holes H1, H2 in the side walls S1, S2. In this lockout position, the first set of lock apertures 324*a*, 324*b* substantially or fully aligns with the second set of lock apertures 334*a*, 334*b* to define a set of lock passages for receiving one or more locking members L (e.g., padlock shackles) to secure the device in the lockout position. In another embodiment (not shown) outward biased flanged tabs may be forced inward by a sliding plate to interlock with aligned holes from outside the side walls.

Figure 9A:
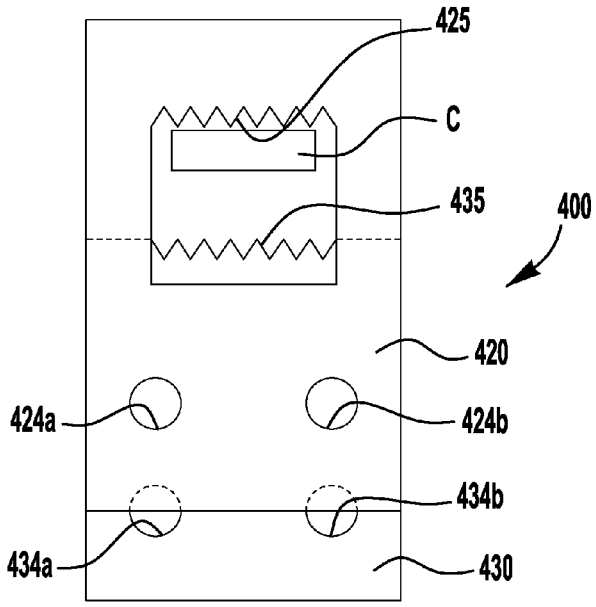
FIG. 9A is a front schematic view of still another exemplary lockout device, shown in a release position.
Figure 9B:
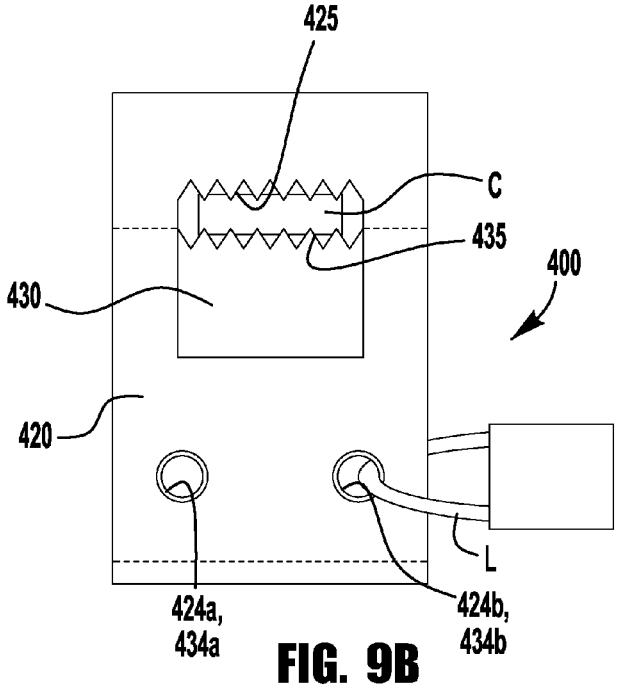
FIG. 9B is a front schematic view of the lockout device of FIG. 9A, shown in a lockout position.

In another exemplary embodiment, a sliding lockout device may be configured for locked gripping engagement with a compressible component, including, for example, a fabric strap or a foam pad. FIGS. 9A and 9B schematically illustrate a lockout device 400 including a first plate 420 having a first gripping portion 425 (or other suitable lockout feature) and a first set of lock apertures 424*a*, 424*b*, and a second plate 430 having a second gripping portion 435 (or other suitable lockout feature) and a second set of lock apertures 434*a*, 434*b*. As shown in FIG. 9A, the first and second gripping portions 425, 435 are spaced apart a first distance d1 greater than a thickness of the component C in the release position, to allow for insertion or withdrawal of the component C. When the second plate 430 is slid (e.g., using slot and guide pin arrangements, as shown and described above) to the lockout position (FIG. 9B), the first and second gripping portions 425, 435 are spaced apart a second distance d2 small enough for gripping, clamping, or frictional engagement with the component. In this lockout position, the first set of lock apertures 424*a*, 424*b* substantially or fully aligns with the second set of lock apertures 434*a*, 434*b* to define a set of lock passages for receiving one or more locking members L (e.g., padlock shackles) to secure the device in the lockout position.

In another exemplary embodiment, a connector lockout device may include first and second plates coupled to each other to define opposed edges of a lockout aperture. In one embodiment, the first and second plates include corresponding opposed first and second interlocking portions sized and positioned to securely interlock with a portion of a connector (e.g., an outer peripheral groove) when the first and second plates are in a lockout position. The first and second interlocking portions are sized and positioned to be disengaged from the portion of the connector when the first and second plates are in a release position. In an exemplary embodiment, each of the first and second plates includes at least a first lock aperture. The first lock aperture of each of the first and second plates are substantially or fully aligned with each other when the first and second plates are in the lockout position, such that insertion of a lock member (e.g., a padlock shackle) through the aligned first apertures prevents movement of the first and second plates to the release position. As used herein, the plates of a lockout device may include any suitable size or shape of components, including flat, cylindrical, and wedge-shaped components.

Figure 10A:
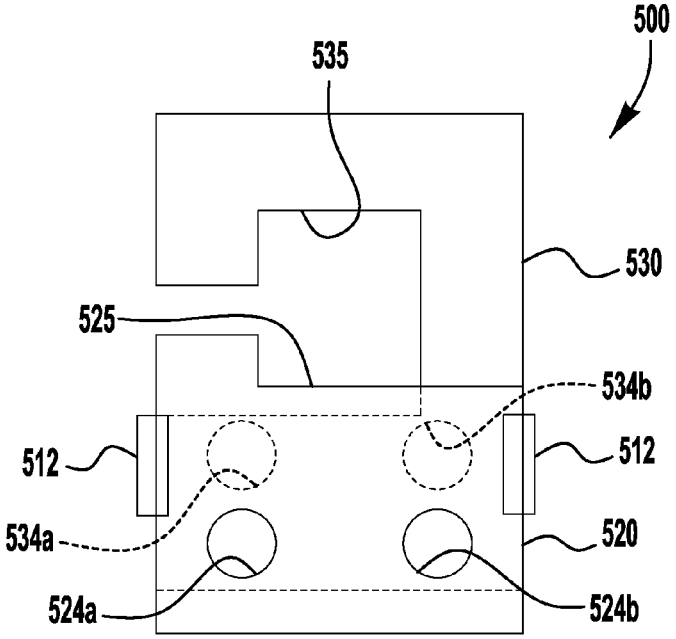
FIG. 10A is a front schematic view of yet another exemplary lockout device, shown in a release position.
Figure 10B:
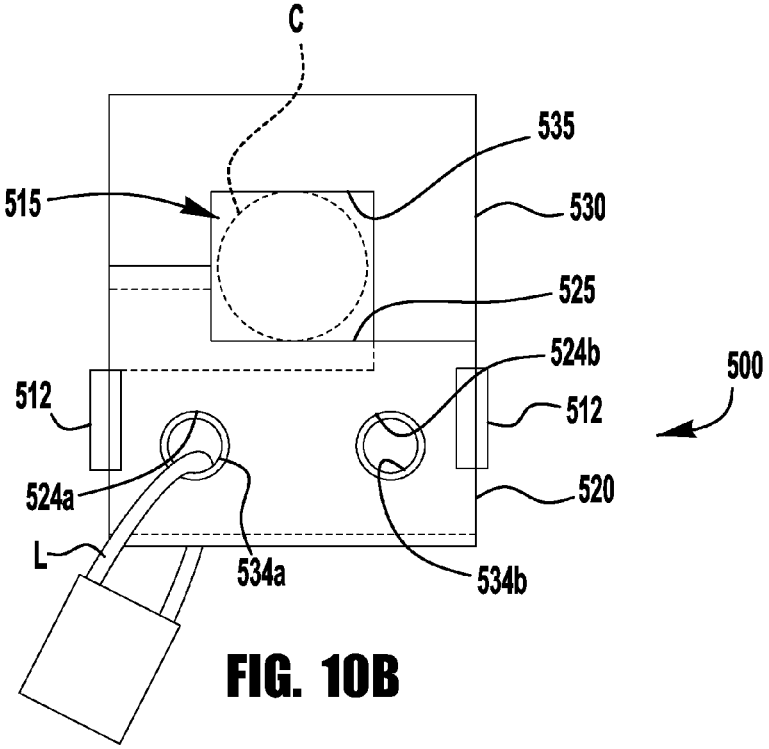
FIG. 10B is a front schematic view of the lockout device of FIG. 10A, shown in a lockout position.
Figure 11A:
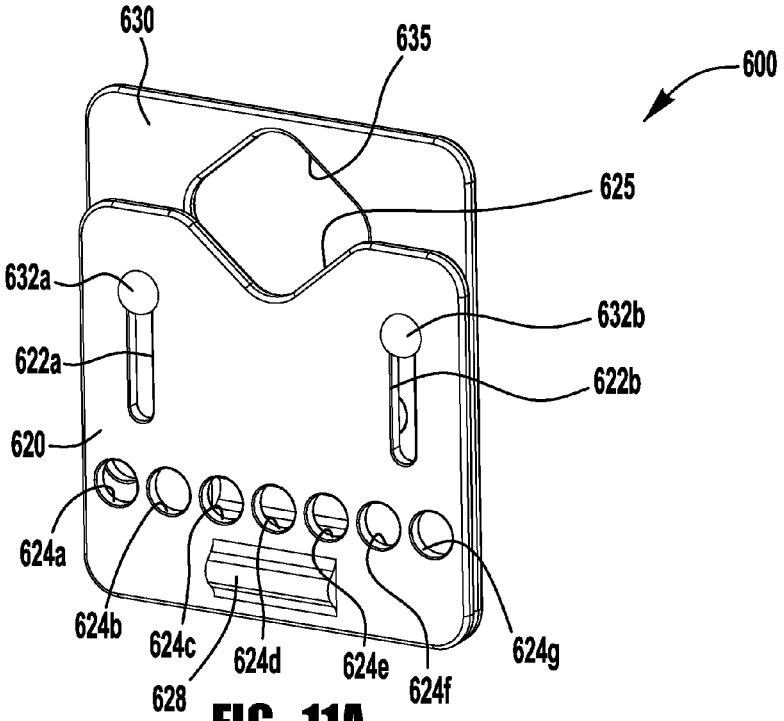
FIG. 11A illustrates a front perspective view of an exemplary connector lockout device.
Figure 11B:
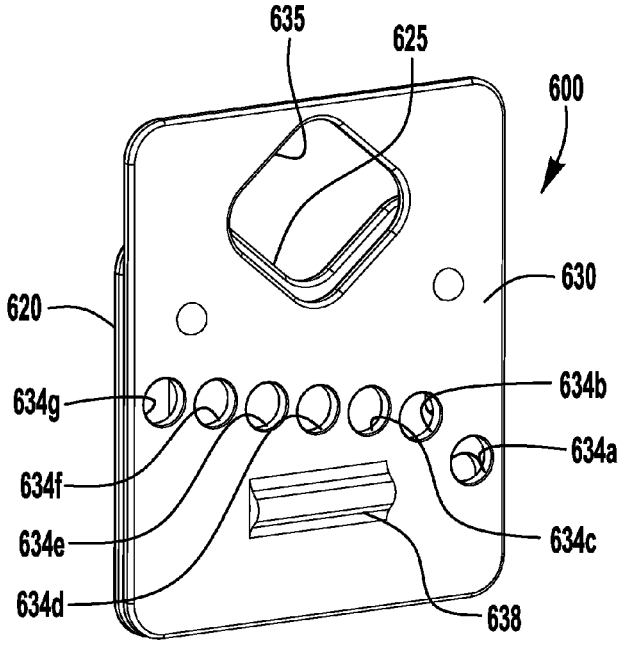
FIG. 11B illustrates a rear perspective view of the lockout device of FIG. 11A.

FIGS. 10A and 10B schematically illustrate an exemplary connector lockout device 500 including first and second plates 520, 530 coupled to each other at one or more sliding attachments (shown schematically at 512) for axial or translational sliding movement of the first and second plates with respect to each other between a release position (FIG. 10A) and a lockout position (FIG. 10B). Any type of sliding attachment of the plates may be used, including, for example, one or more guide pins, tabs, or other such projections extending from one of the first and second plates and received in one or more corresponding guide slots or tracks in the other of the first and second plates for sliding movement therein.

The first plate 520 includes a first interlocking portion 525, and the second plate 530 includes a second interlocking portion 535. When the first and second plates 520, 530 are in the lockout position, the first and second interlocking portions 525, 535 are positioned for interlocking engagement with a portion of a connector C (e.g., a groove around an outer periphery of the connector). When the first and second plates 520, 530 are moved to the release position, the first and second interlocking portions 525, 535 are moved to disengage from the portion of the connector C, such that the lockout device may be removed from the connector. In the illustrated embodiment of FIGS. 10A and 10B, the first interlocking portion 525 forms a first edge and the second interlocking portion 535 forms a second edge opposite the first edge. By sliding the second plate 530 with respect to the first plate 50, the second edge 535 is movable in an axial direction toward the first edge 525, forming an interlocking lockout orifice 515 sized for interlocking engagement with an outer periphery of the connector in the lockout position. The second plate 530 is likewise slideable to move the second edge 535 in an axial direction away from the first edge 525 to expand the orifice 515 to release the connector C.

In one embodiment, the first and second interlocking portions may be separated by a gap in the release position and may abut each other in the lockout position, defining a seam between ends of the interlocking portions. In another exemplary embodiment, as shown, the first and second interlocking portions 525, 535, may overlap in at least the lockout position, for example, to resist efforts to pry the ends of the interlocking portions 525, 535 apart from each other in an effort to remove the lockout device 500 from the connector. In still another embodiment, the ends of the first and second interlocking portions may also overlap in the release position.

Any suitable arrangement may be utilized to secure the first and second plates in the closed position. In the schematic example, the first and second plates 520, 530 include corresponding first and second sets of one or more lock apertures 524*a*, 524*b*, 534*a*, 534*b*. When the first and second plates 520, 530 are in the lockout position, at least one lock aperture in each of the first and second sets of lock apertures 524, 534 substantially or fully align to define a set of lock passages to permit insertion of one or more lock members therethough. When at least one lock member L is inserted through aligned lock apertures 524*a*, 534*a* of the first and second sets of lock apertures 524, 534, sliding movement of the first and second plates 520, 530 to the open or release position is substantially blocked or obstructed. This condition secures the first and second interlocking portions 25, 35 in interlocking orifice-forming alignment, for example, to prevent removal of the lockout device 500 from the connector C.

According to another aspect of the present application, a lockout device (e.g., a connector lockout device) may be configured to be secured in multiple lockout positions, for example, to accommodate interlocking engagement with dimensionally different (e.g., different size and/or shape) external lockout structures. In one embodiment, first and second plates include corresponding first and second sets of lock apertures positioned such that at least one lock aperture of the first set of lock apertures aligns with at least one lock aperture of the second set of lock apertures in each of at least first and second lockout positions to define a lock passage. In one such embodiment, a first lock aperture in the first member aligns with a first lock aperture of the second member in a first lockout position and with a second lock aperture of the second member in a second lockout position. In another exemplary embodiment, a first lock aperture in the first member aligns with a first lock aperture of the second member in a first lockout position, and a second lock aperture of the first member aligns with a second lock aperture of the second member in a second lockout position. This arrangement may provide for small incremental changes in the positions of the first and second members between two or more selectable lockout positions of the lockout features of the first and second members.

Figure 12:
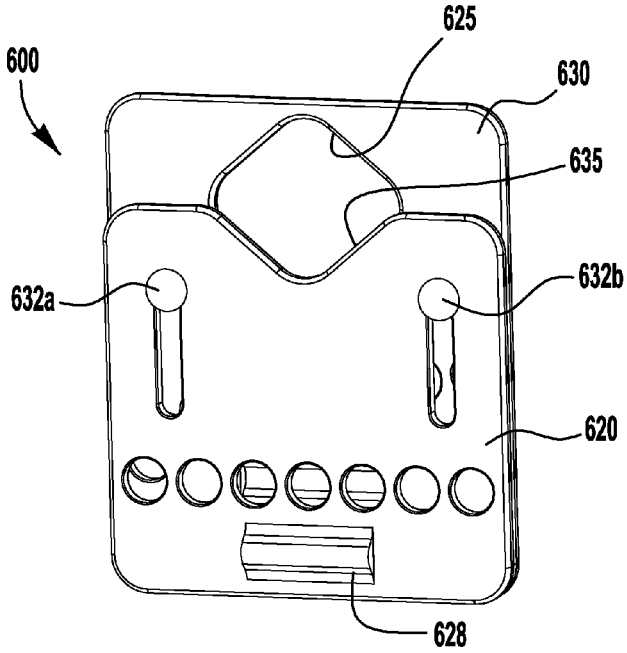
FIG. 12 illustrates a front view of the lockout device of FIG. 11A, shown in a release position.
Figure 13:
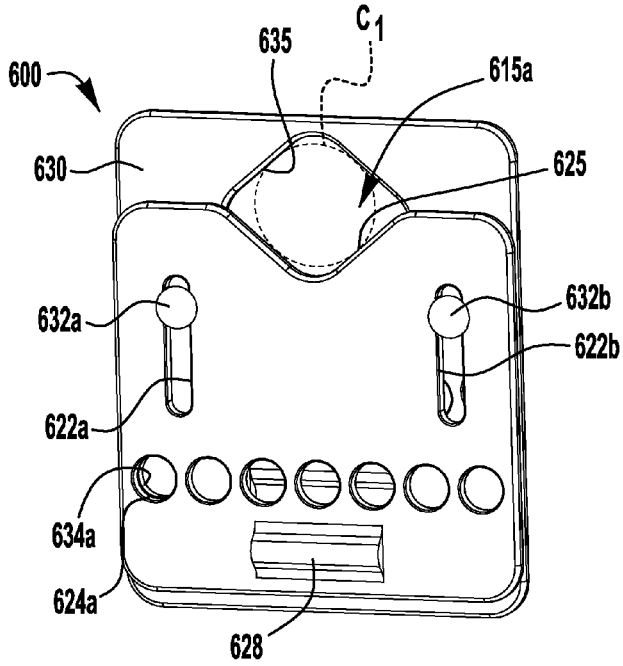
FIG. 13 illustrates a front view of the lockout device of FIG. 11A, shown in a first lockout position.
Figure 14:
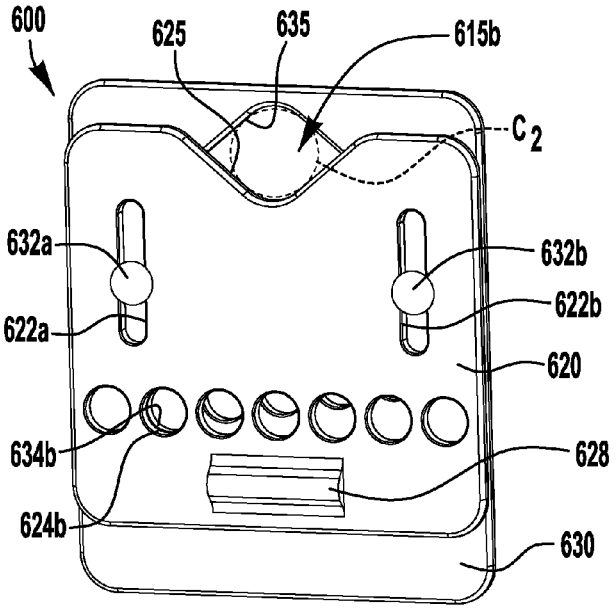
FIG. 14 illustrates a front view of the lockout device of FIG. 11A, shown in a second lockout position.

FIGS. 11A-15 illustrate an exemplary connector lockout device 600 including many of the inventive features described herein. The lockout device 600 includes first and second plates 620, 630 coupled to each other for axial or translational sliding movement of the first and second plates with respect to each other between a release position (FIG. 12) and two or more lockout positions (FIGS. 13 and 14). While any type of sliding attachment of the plates may be used, in the illustrated embodiment, guide pins or other such projections 632*a*, 632*b* (e.g., rivets or other fasteners) extend from the second plate 630 and are received in corresponding guide slots 622*a*, 622*b* in the first plate 620 for sliding movement therein. The guide pins 632*a*, 632*b* may be captured in the corresponding slots 622*a*, 622*b* by an enlarged end portion or head at the end of the guide pin 632*a*, 632*b* to prevent separation from the slots 622*a*, 622*b*. Engagement of the guide pins 632*a-b* with the ends of the corresponding slots 622*a-b* defines a range of positions between a first limit position (which may, but need not, coincide with one of the lockout positions) and a second limit position (which may, but need not, coincide with the release position). The use of multiple guide pin/slot attachments may provide for more secure attachment of the two plates 620, 630 and greater resistance to efforts to pry apart the plates 620, 630. In the illustrated embodiment, the guide pins 632*a*, 632*b* are captured in the corresponding slots 622*a*, 622*b* along an entire range of motion within the slots, for example, to securely retain the plates 620, 630 together when the device 600 is not in use. In another embodiment (not shown), the guide pins are permitted to separate from the corresponding slots when the plates are in the open position, for example, by providing the slots with an enlarged end. This arrangement may facilitate assembly and disassembly of the lockout device for example, for efficient storage of the lockout device in a disassembled condition, or for customization by assembly with lockout plates of different sizes and configurations.

The first plate 620 includes a first interlocking edge portion 625, and the second plate 630 includes a second interlocking edge portion 635 opposite the first interlocking edge portion 625. When the first and second plates 620, 630 are in a first lockout position (FIG. 13), the first and second interlocking edge portions 625, 635 form a first interlocking orifice 615*a* sized for interlocking engagement with a first connector C1. When the first and second plates 620, 630 are in a second lockout position (FIG. 14), the first and second interlocking edge portions 625, 635 form a second interlocking orifice 615*b* sized for interlocking engagement with a second connector C2 (e.g., a connector having a smaller diameter than the first connector). While the interlocking edge portions may be provided in a variety of shapes, in one embodiment, the interlocking edge portions are shaped to have diverging side portions facing each other, to form a range of interlocking orifices, varied by sliding movement of the lockout plates, with the range of orifices being sized to accommodate connectors having a range of diameters. In the illustrated embodiment, the first and second interlocking edge portions 625, 635 are substantially "V" shaped. In the lockout positions, the interlocking edge portions 625, 635 overlap, for example, to provide further rigidity of the interlocking orifices 615*a*, 615*b* and to resist efforts to pry the ends of the hasp segments 625, 635 apart from each other in an effort to remove the connector C1, C2 from the interlocking orifice 615*a*, 615*b*.

When the first and second plates 620, 630 are moved toward the release position (FIG. 12), the first and second interlocking edge portions 625, 635 spread apart from each other to permit insertion of a connector between the interlocking edge portions 625, 635, or to permit removal of the connector from the interlocking edge portions. As shown in FIG. 12, this release position may, but need not, coincide with a limit position of the guide pins 632*a*, 632*b* within the slots 622*a*, 622*b*.

A connector lockout device may be configured to provide for any number of lockout positions to accommodate any number of different connectors. In the illustrated embodiment, the first and second plates 620, 630 include corresponding first and second sets of first, second, third, fourth, fifth, sixth and seventh lock apertures 124*a-g*, 134*a-g*, positioned to provide for first, second, third, fourth, fifth, sixth and seventh lockout positions. In the illustrated example, the lock apertures 634*a-g* of the second plate 630 are incrementally staggered in an axial direction across the lateral width of the second plate 630 to provide for incremental first, second, third, fourth, fifth, sixth, and seventh lockout positions. The staggered distances between adjacent lock apertures 634*a-g* may be selected to provide desired incremental sizes of the interlocking orifices (and may, for example, be a distance less than a diameter or less than a radius of each lock aperture). In one exemplary embodiment, the incremental sizes of the interlocking orifices may correspond with groove dimensions for standard pneumatic fitting connectors (including, for example, diameters of approximately 0.28 inches, 0.33 inches, 0.40 inches, 0.46 inches, 0.51 inches, 0.57 inches, and 0.81 inches).

When the first and second plates 620, 630 are in the first lockout position (FIG. 13), the first lock apertures 624*a*, 634*a* substantially or fully align to define a lock passage to permit insertion of a lock member therethough. When at least one lock member is inserted through the first lock apertures 624*a*, 634*a*, sliding movement of the first and second plates 620, 630 toward the release position is substantially blocked or obstructed. This condition secures the first and second interlocking edge portions 625, 635 in first orifice 615*a* forming alignment, for example, to prevent removal of a first connector from the interlocking orifice 615*a*.

When the first and second plates 620, 630 are in the second lockout position (FIG. 14), the second lock apertures 624*b*, 634*b* substantially or fully align to define a lock passage to permit insertion of a lock member therethough. When at least one lock member is inserted through the second lock apertures 624*b*, 634*b*, sliding movement of the first and second plates 620, 630 toward the release position is substantially blocked or obstructed. This condition secures the first and second interlocking edge portions 625, 635 in first interlocking orifice 615*b* forming alignment, for example, to prevent removal of a second connector from the interlocking orifice 615*b*.

Figure 15:
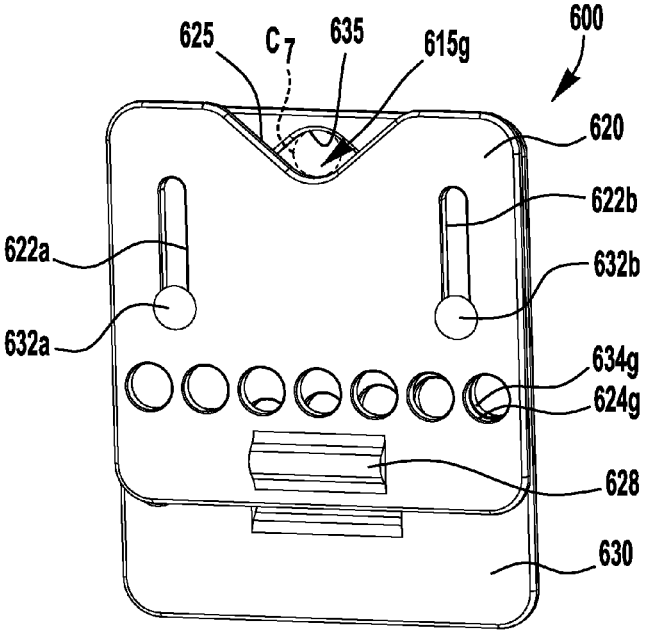
FIG. 15 illustrates a front view of the lockout device of FIG. 11A, shown in a third lockout position.

When the first and second plates 620, 630 are in one of the third, fourth, fifth, sixth, and seventh lockout positions, corresponding ones of the third, fourth, fifth, sixth, and seventh lock apertures 624*c-g*, 634*c-g* substantially or fully align to define a lock passage to permit insertion of a lock member therethough. When at least one lock member is inserted through the aligned lock apertures 624*c-g*, 634*c-g*, sliding movement of the first and second plates 620, 630 toward the release position is substantially blocked or obstructed. This condition secures the first and second interlocking edge portions 625, 635 in alignment to form a corresponding third, fourth, fifth, sixth, or seventh orifice 615*c-g*, for example, to prevent removal of a third, fourth, fifth, sixth, or seventh connector from the interlocking orifice 115*c-g*. As shown in FIG. 15, the seventh lockout position, in which the seventh lock apertures 624*g*, 634*g* substantially or fully align, may, but need not, coincide with a limit position of the guide pins 632*a*, 632*b* within the slots 622*a*, 622*b*.

Still other features and configurations may additionally or alternatively be utilized in a safety lockout device in accordance with the present application. For example, one or both of the plates 620, 630 may be provided with user engageable projections or pads 628 to facilitate sliding movement of the plates 620, 630 by the user. As another example, one or both of the plates may be provided with labels (not shown), for example, to provide lockout information.

While the connector lockout device components may be provided in many different materials, in one embodiment, the plates 620, 630 are provided in plastic or some other dielectric or non-conductive material, for example, to reduce the risk of electrical shock to the user. In other embodiments, these components may be provided in metals, such as steel or aluminum, or in some other suitable material. The connector lockout device components may be provided in many different sizes, shapes, and dimensional configurations, for example, to accommodate different equipment lockout apertures and padlocks or other retaining members.

In other embodiments (not shown), the plates may be provided with at least one pair of smaller diameter lock apertures, such that a smaller diameter shackle may be tightly secured to the safety lockout hasp. In still other embodiments (not shown), the plates may be provided with at least one pair of enlarged or elongated lock apertures, such that a multiple padlocks or other retaining members may be secured through a single pair of lock apertures.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

We claim:

1. A lockout device comprising:

a first member including a first lockout feature and a first set of apertures; and a second member including a second lockout feature and a second set of apertures, the second member being slideable with respect to the first member and restricted to a range of positions between a first limit position and a second limit position, the range of positions including a lockout position in which the first and second lockout features are positioned to interlock with an external structure, and a release position in which the first and second lockout features are positioned to disengage from the external structure;

wherein when the second member is in the lockout position, each of the first set of apertures substantially aligns with a corresponding one of the second set of apertures to define a set of passages for receiving a lock member having a cross-section corresponding to the aligned apertures to secure the second member in the lockout position; and further wherein when the second member is moved out of the lockout position to any other position in the range of positions, the first member at least partially blocks each of the second set of apertures and the second member at least partially blocks each of the first set of apertures, such that the lock member cannot be assembled with the lockout device to secure the second member in any position other than the lockout position.

2. The lockout device of claim 1, wherein the first member comprises a first plate and the second member comprises a second plate.

3. The lockout device of claim 1, wherein the first and second lockout features comprise first and second hasp segments, the first and second hasp segments forming an enclosed hasp in the lockout position.

4. The lockout device of claim 1, wherein the first member comprises a slot and the second member comprises a projection disposed within the slot and slideable between first and second ends of the slot to define the first and second limit positions of the second member.

5. The lockout device of claim 4, wherein the projection includes an enlarged end portion sized to prevent withdrawal of the projection from the slot, thereby securing the second member to the first member.

6. The lockout device of claim 4, wherein second member comprises a raised detent spaced apart from the projection and received in the slot when the second member is in the lockout position, to resist movement of the second member out of the lockout position.

7. The lockout device of claim 1, wherein the first member comprises a plurality of slots and the second member comprises a plurality of projections each disposed within a corresponding one of the plurality of slots and slideable between first and second ends of the corresponding slot to define the first and second limit positions of the second member.

8. The lockout device of claim 1, wherein the lockout position coincides with the first limit position.

9. The lockout device of claim 8, wherein the first set of apertures comprises first and second adjacent axially aligned apertures and the second set of apertures comprises a third aperture substantially aligned with the first aperture in the first limit position and a fourth aperture substantially aligned with the second aperture in the first limit position.

10. The lockout device of claim 9, wherein a distance between center points of the first and second apertures is greater than the range of positions of the second member, thereby preventing substantial alignment of the third aperture with the second aperture.

11. A lockout device comprising:

a first plate including a first lockout feature and at least a first aperture; and a second plate including a second lockout feature and at least a second aperture, the second plate including a projection disposed within a longitudinal slot in the first plate and slideable between first and second ends of the slot to define a range of positions between first and second limit positions of the second plate with respect to the first plate, wherein the projection includes an enlarged end portion extending laterally outward of the longitudinal slot and sized to prevent withdrawal of the projection from the slot, thereby securing the second plate against separation from the first plate;

wherein the range of positions includes a first lockout position in which the first and second lockout features are positioned to interlock with a first external structure, and a release position in which the first and second lockout features are positioned to disengage from the first external structure; and further wherein when the second plate is in the first lockout position, the first aperture substantially aligns with the second aperture to define a first passage for receiving a lock member having a cross-section corresponding to the aligned first and second apertures to secure the second plate in the first lockout position.

12. The lockout device of claim 11, wherein the first and second lockout features comprise first and second interlocking edge portions defining a first locking orifice in the first lockout position, the first locking orifice being sized to interlock with an outer peripheral groove in the first external structure.

13. The lockout device of claim 11, wherein the first plate further includes a third aperture and the second plate further includes a fourth aperture, wherein the range of positions includes a second lockout position different from the first lockout position, in which the first and second lockout features are positioned to interlock with a second external structure, wherein when the second plate is in the second lockout position, the third aperture substantially aligns with the fourth aperture to define a second passage for receiving the lock member, to secure the second plate in the second lockout position.

14. The lockout device of claim 13, wherein the first and second lockout features comprise first and second interlocking edge portions defining a first locking orifice in the first lockout position, the first locking orifice being sized to interlock with a first outer peripheral groove in the first external structure, the first and second interlocking edge portions further defining a second locking orifice in the second lockout position, the second locking orifice being sized to interlock with a second outer peripheral groove in the second external structure.

15. The lockout device of claim 14, wherein each of the first and second interlocking edge portions includes diverging side portions facing the other of the first and second interlocking edge portions, such that the second locking orifice is larger than the first locking orifice.

16. The lockout device of claim 11, wherein the first and second lockout features comprise first and second hasp portions, the first and second hasp portions forming an enclosed hasp in the first lockout position.

17. The lockout device of claim 11, wherein the second plate comprises a raised detent spaced apart from the projection and received in the slot when the second plate is in the lockout position, to resist movement of the second plate out of the lockout position.

18. A lockout device comprising:

a first member including a first lockout feature and first and second apertures; and a second member including a second lockout feature and third and fourth apertures, the second member being assembled with the first member and slideable in an axial direction with respect to the first member and restricted to a range of sliding positions between a first limit position and a second limit position, wherein the range of positions includes a first lockout position in which the first and second lockout features are positioned to interlock with a first external structure, and a second lockout position, different from the first lockout position, in which the first and second lockout features are positioned to interlock with a second external structure dimensionally different from the first external structure;

wherein when the second member is in the first lockout position, the first aperture substantially aligns with the third aperture to define a first passage for receiving a lock member having a cross-section corresponding to the aligned first and third apertures to secure the second member in the first lockout position; and wherein when the second member is in the second lockout position, the fourth aperture substantially aligns with the second aperture to define a second passage for receiving the lock member to secure the second member in the second lockout position.

19. The lockout device of claim 18, wherein the first and second lockout features comprise first and second interlocking edge portions defining a first locking orifice in the first lockout position, the first locking orifice being sized to interlock with a first outer peripheral groove in the first external structure, the first and second interlocking edge portions further defining a second locking orifice in the second lockout position, the second locking orifice being sized to interlock with a second outer peripheral groove in a second external structure.

20. The lockout device of claim 19, wherein each of the first and second interlocking edge portions includes diverging side portions facing the other of the first and second interlocking edge portions, such that the second locking orifice is larger than the first locking orifice.

* * * * *